US007659854B2

(12) United States Patent
Kakinoki

(10) Patent No.: US 7,659,854 B2
(45) Date of Patent: Feb. 9, 2010

(54) ANTENNAS FOR CARD DEVICES

(75) Inventor: Wataru Kakinoki, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 640 days.

(21) Appl. No.: 10/575,810

(22) PCT Filed: Mar. 15, 2005

(86) PCT No.: PCT/JP2005/004551

§ 371 (c)(1),
(2), (4) Date: Apr. 13, 2006

(87) PCT Pub. No.: WO2005/112187

PCT Pub. Date: Nov. 24, 2005

(65) Prior Publication Data

US 2009/0066605 A1 Mar. 12, 2009

(30) Foreign Application Priority Data

May 17, 2004 (JP) ..... 2004-146605

(51) Int. Cl.
*H01Q 1/24* (2006.01)

(52) U.S. Cl. ..... 343/702; 343/700 MS; 343/872

(58) Field of Classification Search ..... 343/702, 343/700 MS, 872; 361/752
See application file for complete search history.

(56) References Cited

U.S. PATENT DOCUMENTS

2003/0123235 A1* 7/2003 Hsu et al. ..... 361/752

FOREIGN PATENT DOCUMENTS

| | | |
|---|---|---|
| JP | 2001-69029 | 3/2001 |
| JP | 2001-320212 | 11/2001 |
| JP | 2001-339211 | 12/2001 |
| JP | 2002-374111 | 12/2002 |

OTHER PUBLICATIONS

International Search Report PCT/JP2005/004551 dated Dec. 7, 2005.
Notification of Reason of Refusal issued Jun. 19, 2007 in the corresponding Japanese patent application with English language translation.
Official communication issued in counterpart Chinese Application No. 200580000686.3, mailed on Apr. 10, 2009.

* cited by examiner

*Primary Examiner*—Hoang V Nguyen
(74) *Attorney, Agent, or Firm*—Keating & Bennett, LLP

(57) ABSTRACT

In a card device having a circuit substrate housed in a card casing and an antenna disposed rotatably on the exterior of the card casing, an antenna rotary shaft composed of a conductive material is provided at the base end of the antenna. The antenna rotary shaft extends from the exterior to the interior of the card casing along a substrate surface of the circuit substrate via a through hole of the card casing in such a manner that the antenna rotary shaft is supported rotatably by the card casing while being elevated from the circuit substrate. A section of the circuit substrate that is opposed to the antenna rotary shaft has a feeding terminal fixed thereto. The feeding terminal has a pair of antenna-rotary-shaft elastically-pressing portions that sandwich and electrically contact the antenna rotary shaft from opposite sides with elastic forces in a surface-contact fashion.

7 Claims, 4 Drawing Sheets

ANTENNAS FOR CARD DEVICES

CROSS-REFERENCE TO RELATED APPLICATION

The present application is a 35 U.S.C. §371 national phase conversion of PCT/JP2005/004551 filed Mar. 15, 2005, which claims priority of Japanese application no. 2004-146605 filed May 15, 2004, which are incorporated herein in their entirety.

BACKGROUND OF THE INVENTION

1. Field of the Invention

The present invention relates to antennas for card devices loadable into electronic apparatuses, such as personal computers.

2. Background Art

FIG. 6 is a simplified schematic diagram illustrating an example of a card device. A card device 41 includes a card casing 42, a circuit substrate 43 housed inside the card casing 42, and an antenna 44 disposed rotatably on the exterior of the card casing 42.

The base end of the antenna 44 is provided with an antenna rotary shaft 45 composed of a conductive material. One side wall of the card casing 42 is provided with a through hole (not numbered) through which the antenna rotary shaft 45 extends from the exterior to the interior of the card casing 42. The antenna rotary shaft 45 extending into the card casing 42 through this through hole is electrically connected to an electric circuit (not shown) disposed on the circuit substrate 43. Accordingly, the antenna 44 is electrically connected to the electric circuit on the circuit substrate 43 via the antenna rotary shaft 45.

Two patent documents of background interest are:

(Patent Document 1) Japanese Unexamined Patent Application Publication No. 2001-339211; and (Patent Document 2) Japanese Unexamined Patent Application Publication No. 2002-374111.

Because the antenna rotary shaft 45 is rotatable, it is not desirable to connect the antenna rotary shaft 45 directly to the circuit substrate 43 due to various problems that may be caused by the rotation of the antenna rotary shaft 45. Accordingly, as shown in a schematic cross-sectional view in FIG. 7, the antenna rotary shaft 45 is electrically connected to the electric circuit on the circuit substrate 43 via a feeding terminal 46 (for example, see Patent Document 1).

In the example shown in FIG. 7, the feeding terminal 46 is composed of a conductive material and includes an antenna-rotary-shaft connection part 46A that is in contact with the antenna rotary shaft 45, and a circuit connection part 46B that is in contact with an antenna connection land 47 of the electric circuit, which is disposed on a substrate surface of the circuit substrate 43. Since the antenna rotary shaft 45 is in contact with the antenna-rotary-shaft connection part 46A of the feeding terminal 46 and the circuit connection part 46B of the feeding terminal 46 is in contact with the antenna connection land 47 of the circuit substrate 43, the antenna 44 is electrically connected to the electric circuit of the circuit substrate 43 via the antenna rotary shaft 45 and the feeding terminal 46. Reference numeral 48 in FIG. 7 indicates a wiring pattern for connecting the antenna connection land 47 to, for example, a radio-communication high-frequency circuit (not shown) in the electric circuit.

If the antenna rotary shaft 45 is electrically connected to the electric circuit of the circuit substrate 43 via the feeding terminal 46 as shown in FIG. 7, the following problems may exist. Specifically, when the circuit substrate 43 is viewed from above, the feeding terminal 46 has a configuration in which the part 46A in contact with the antenna rotary shaft 45 and the part 46B in contact with the antenna connection land 47 of the circuit substrate 43 are disposed side-by-side, in parallel. Furthermore, in view of preventing a connection failure between the antenna rotary shaft 45 and the antenna connection land 47, it is not desirable to reduce the size of the antenna-rotary-shaft connection part 46A and the circuit connection part 46B. For these reasons, it is difficult to reduce the area occupied by the feeding terminal 46 on the card device 41.

Furthermore, a signal transferred between the antenna 44 and the electric circuit of the circuit substrate 43 must travel through two contact points, namely, the contact point between the antenna-rotary-shaft connection part 46A of the feeding terminal 46 and the antenna rotary shaft 45, and the contact point between the circuit connection part 46B of the feeding terminal 46 and the antenna connection land 47 of the circuit substrate 43. Since the two conductors are only in contact with each other at each of these contact points, the signal may easily be subject to a conduction failure. Moreover, this may also be problematic in inducing a large conduction loss of the signal. These problems may possibly result in lower reliability of the radio communication performance of the card device 41. On the other hand, gold-plating the surface of the antenna connection land 47, for example, to enhance the reliability of the contact between the feeding terminal 46 and the antenna connection land 47 can lead to higher costs.

SUMMARY OF THE INVENTION

One aspect of the present invention provides the following structure for solving the above-mentioned problems. Specifically, the present invention provides a card device, which includes a card casing housing a circuit substrate; and an antenna which is disposed rotatably on an exterior of the card casing and is electrically connected to an electric circuit provided on the circuit substrate. A side wall of the card casing is provided with a through hole through which an antenna rotary shaft extends, the antenna rotary shaft being disposed at a base end of the antenna and being composed of a conductive material. The antenna rotary shaft extends from the exterior of the card casing towards the interior of the card casing through the through hole. The antenna rotary shaft is disposed along a substrate surface of the circuit substrate in the card casing while being separated from the substrate surface. A section of the circuit substrate that is opposed to the antenna rotary shaft has a feeding terminal fixed thereto, the feeding terminal being electrically connected to the electric circuit of the circuit substrate. The feeding terminal has a pair of pressing portions that sandwich the antenna rotary shaft from opposite sides with elastic forces. The pair of pressing portions is in pressure-contact with the antenna rotary shaft by being in surface-contact with a peripheral surface of the antenna rotary shaft. The antenna rotary shaft is electrically connected to the electric circuit of the circuit substrate via the pressing portions.

According to this aspect of the present invention, the feeding terminal is fixed to a section of the circuit substrate that is opposed to the antenna rotary shaft, which is disposed in an elevated manner from the circuit substrate. Moreover, the feeding terminal has a pair of pressing portions that sandwich the antenna rotary shaft from opposite sides with elastic forces. In other words, with respect to the vertical direction, the feeding terminal according to the present invention has one part that is in contact with the antenna rotary shaft and another part that is connected to the electric circuit of the circuit substrate. According to this structure, the area occupied by the feeding terminal in the card device can be reduced more readily in comparison to a feeding terminal having the antenna-rotary-shaft connection part and the circuit connection part disposed side-by-side and in parallel to each other.

Furthermore, in this aspect of the present invention, the feeding terminal sandwiches the antenna rotary shaft from opposite sides with the pair of pressing portions. Moreover, because these pressing portions are in surface-contact with the antenna rotary shaft, the contact area between the antenna rotary shaft and the feeding terminal is large, thereby achieving a stable electrical connection between the antenna rotary shaft and the feeding terminal.

Embodiments of the present invention will now be described with reference to the drawings.

DETAILED DESCRIPTION OF EMBODIMENTS OF THE INVENTION

Figure 2:
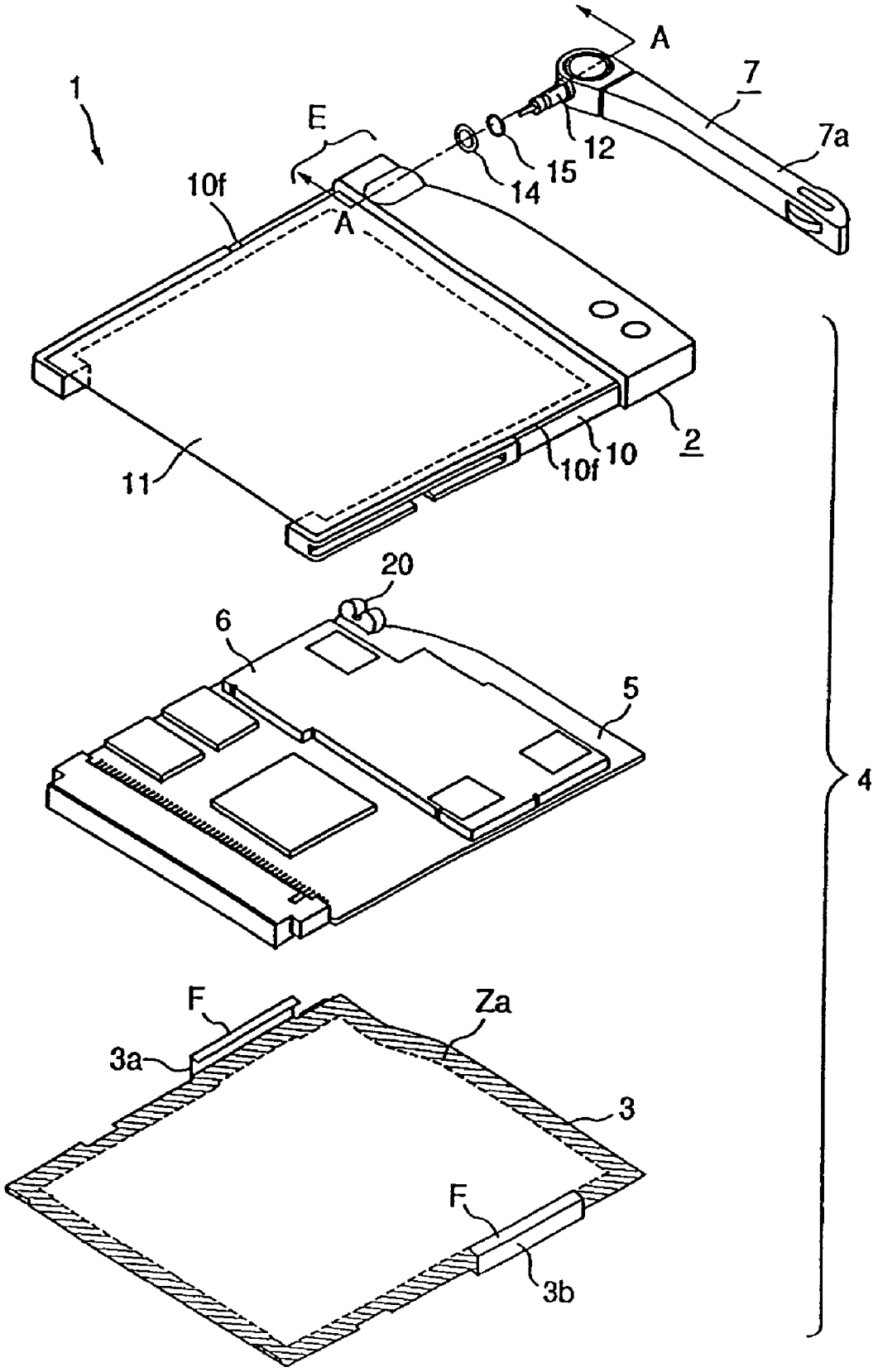
FIG. 2 is an exploded view of the card device according to the embodiment of the present invention.

Referring to a schematic exploded view of FIG. 2, a card device according to an embodiment includes a card casing 4 including a combination of a front cover 2 and a back cover 3, a circuit substrate 5 housed in the card casing 4, and an antenna 7 which is disposed rotatably on the exterior of the card casing 4 and is electrically connected to an electric circuit 6 provided on the circuit substrate 5. The card device 1 (which may be, for example, a CF card or a PC card) is loadable into a card-holding portion of an electronic apparatus, such as a personal computer. The card device 1 in this example is an extended type having an extended portion E that protrudes from the card-holding portion when the card device is inserted in the card-holding portion. CF (Compact Flash) is a trademark registered in the Japanese Patent Office.

The front cover 2 has an integrated structure that includes a frame 10 defining side walls and composed of, for example, a resin material, and a panel 11 formed of, for example, a metal plate. On the other hand, the back cover 3 is formed of, for example, a metal plate. The back cover 3 has extended wall segments 3*a*, 3*b* extending upward along the outer surfaces of the side walls of the front cover 2 (i.e. the frame 10). The tip of each of the extended wall segments 3*a*, 3*b* is bent, thereby forming a hook portion F. The front cover 2 is provided with hook-receiving portions 10*f* onto which these hook portions F are securely hooked.

In this embodiment, the bottom surface of the frame 10 of the front cover 2 is attached to the rim portion of the back cover 3 (for example, a shaded portion Za shown in FIG. 2) with a bonding material, which may be, for example, an adhesive or a double-sided tape. Moreover, the back cover 3 is secured to the front cover 2 by hooking the hook portions F onto the hook-receiving portions 10*f*. Accordingly, the card casing 4 is formed by combining the front cover 2 with the back cover 3.

In this embodiment, the circuit substrate 5 is a one-side mounting type in which components are mounted only on the top surface thereof. The back surface of the circuit substrate 5 may be attached to the back cover 3 with a bonding material, such as a double-sided tape and an adhesive, or may be attached to the back cover 3 by thermo-compression bonding. In this fixed state, the circuit substrate 5 is housed in the interior space of the card casing 4 formed of the combination of the front cover 2 and the back cover 3.

An antenna 7 includes a protective casing 7*a* composed of, for example, a resin material, and an antenna body (not shown) disposed inside the protective casing 7*a* and provided for sending and receiving electric waves. The base end of the antenna 7 is provided with an antenna rotary shaft 12 which is electrically connected to the antenna body and is composed of a conductive material.

Figure 1:
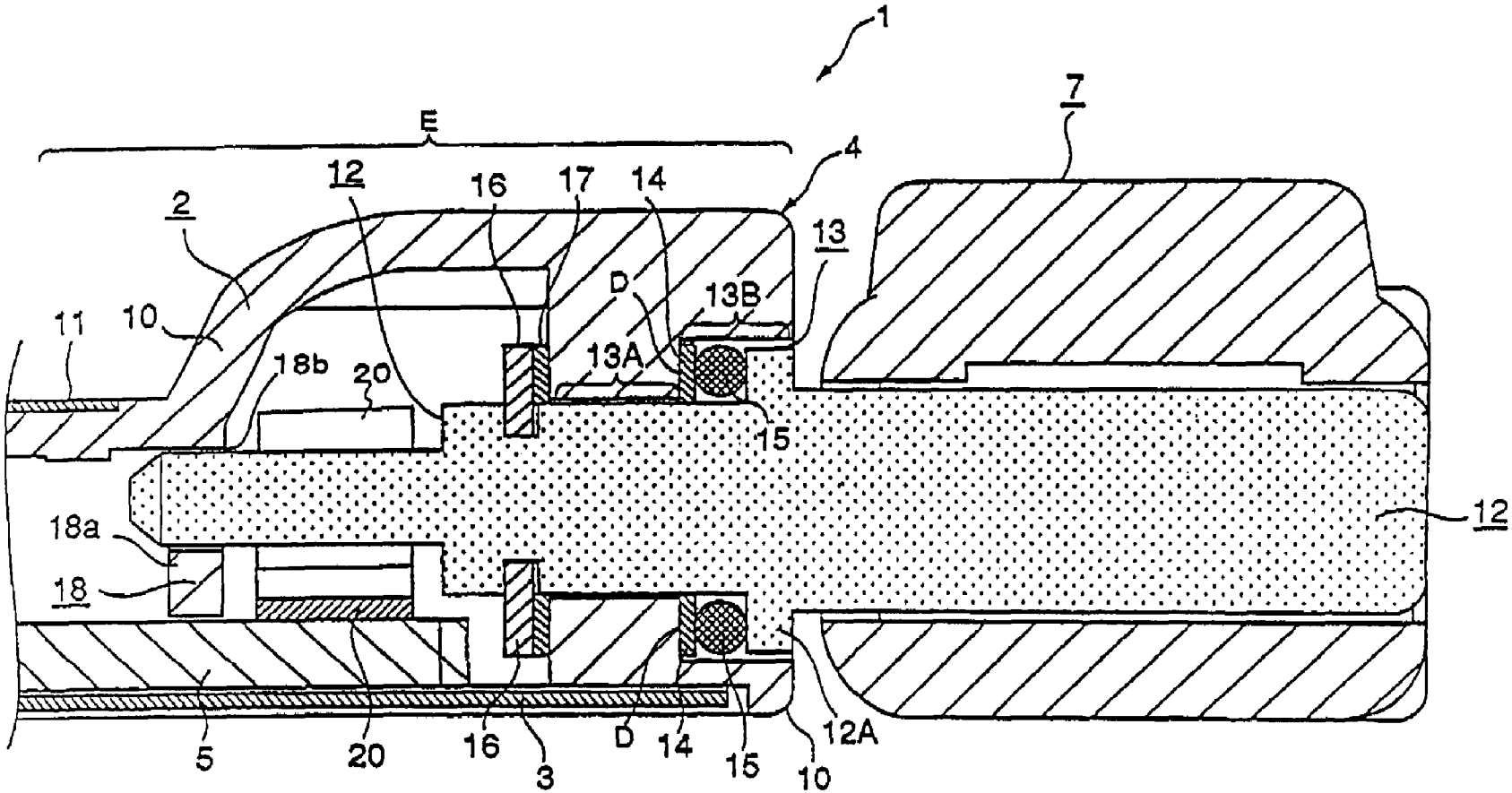
FIG. 1 is a schematic cross-sectional view illustrating relevant components included in a card device according to an embodiment of the present invention.

FIG. 1 is a schematic cross-sectional view taken along line A-A in FIG. 2. Referring to FIG. 1, in the front cover 2, the side wall of the frame 10 that forms the extended portion E is provided with a through hole 13 through which the antenna rotary shaft 12 extends. The through hole 13 is for inserting the antenna rotary shaft 12 from the exterior to the interior of the card casing 4 along the substrate surface of the circuit substrate 5. The through hole 13 has an engagement portion 13A through which the antenna rotary shaft 12 extends without forming substantially any gap therebetween, and a larger-diameter portion 13B which is given a larger diameter than the engagement portion 13A. The engagement portion 13A and the larger-diameter portion 13B are disposed in that order from the interior to the exterior of the card casing 4.

The larger-diameter portion 13B of the through hole 13 contains therein a washer 14 which abuts on a step D formed between the larger-diameter portion 13B and the engagement portion 13A, and an O ring 15 which abuts on the washer 14. The antenna rotary shaft 12 is capable of extending through the washer 14 and the O ring 15.

The base end of the antenna rotary shaft 12 is provided with a projection 12A that fits in the larger-diameter portion 13B of the through hole 13. For example, when inserting the antenna rotary shaft 12 into the through hole 13, the O ring 15 and the washer 14 are preliminarily fitted onto the antenna rotary shaft 12 in that order, and in this state, the antenna rotary shaft 12 is inserted into the through hole 13 from the exterior of the card casing 4. In this embodiment, the washer 14 abuts on the step D in the through hole 13 and the O ring 15 abuts on the washer 14, and moreover, the projection 12A of the antenna rotary shaft 12 abuts on the O ring 15, whereby the antenna rotary shaft 12 is stopped from being inserted any further. In order to prevent the antenna rotary shaft 12 in this state from coming out, a washer 17 and an E ring 16 are fitted onto the antenna rotary shaft 12 from inside the card casing 4. The E ring 16 is secured to the rim of the through hole 13 inside the card casing 4 via the washer 17 so as to retain the antenna rotary shaft 12. The through hole 13, the washers 14, 17, the O ring 15, and the E ring 16 allow the antenna rotary shaft 12 to be mounted to the front cover 2 in a rotatable fashion.

In this embodiment, the rotational adjustment position of the antenna 7 is maintained by a frictional force generated at the contact point between the O ring 15 and the projection 12A of the antenna rotary shaft 12. The surface of the O ring 15 is coated with a lubricating material for friction adjustment so that the frictional force generated between the projection 12A of the antenna rotary shaft 12 and the O ring 15 does not interfere with the smooth rotation of the antenna 7 while still having the capability to maintain the rotational adjustment position of the antenna 7.

In this embodiment, the washer 14 is disposed between the step D in the through hole 13 and the O ring 15, and moreover, the washer 17 is disposed between the rim of the through hole 13 inside the card casing 4 (i.e. the inner wall of the frame 10) and the E ring 16. The washers 14, 17 prevent friction from being produced between the step D in the through hole 13 and the O ring 15 and also between the inner wall of the frame 10 and the E ring 16, thereby preventing a reduced life span of each of the components, such as the frame 10, the O ring 15, and the E ring 16, caused by friction.

An inner surface of the front cover 2 is provided with an antenna-rotary-shaft supporting portion 18 at a position where the tip of the antenna rotary shaft 12 is disposed. In this embodiment, the antenna-rotary-shaft supporting portion 18 has a plate-like protrusion 18*a* protruding from the inner surface of the frame 10 towards the interior of the card casing 4, and an antenna-rotary-shaft insertion hole 18*b* in the protrusion 18*a*. The tip of the antenna rotary shaft 12 extends through the hole 18*b* of the antenna-rotary-shaft supporting portion 18 so that the antenna rotary shaft 12 is supported rotatably by the front cover 2 (frame 10) while being elevated from the circuit substrate 5.

In this embodiment, an antenna connection land (not shown) is disposed on the circuit substrate 5 at a position facing a section of the antenna rotary shaft 12 between the side wall of the frame 10 provided with the through hole 13 and the antenna-rotary-shaft supporting portion 18. The antenna connection land functions as an antenna connection part of the electric circuit 6 disposed on the circuit substrate 5. The antenna connection land has a feeding terminal 20 composed of a conductive material mounted (surface-mounted) thereon with a bonding material, such as solder. Consequently, the feeding terminal 20 is fixed to the circuit substrate 5 and is electrically connected to the electric circuit 6 on the circuit substrate 5.

Figure 3:
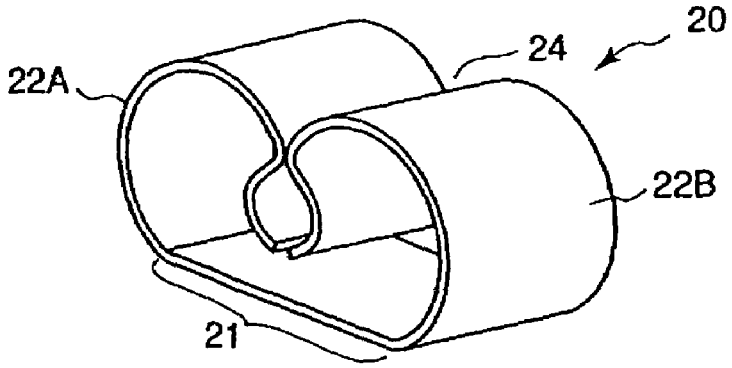
FIG. 3 is a schematic perspective view illustrating an example of a feeding terminal incorporated in the card device shown in FIGS. 1 and 2.

The feeding terminal 20 has the structure shown in FIG. 3 in a perspective view. The feeding terminal 20 is formed by bending a metal plate, and includes a mounting portion 21 which is to be mounted to the circuit substrate 5 with a bonding material (such as solder), and a pair of antenna-rotary-shaft elastically-pressing portions 22A, 22B.

Figure 4A:
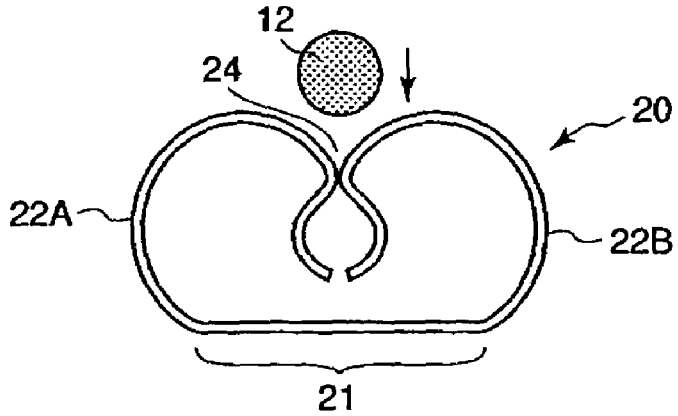
FIG. 4*a* is a schematic diagram illustrating a state in which the feeding terminal and an antenna rotary shaft are not yet combined with each other.
Figure 4B:
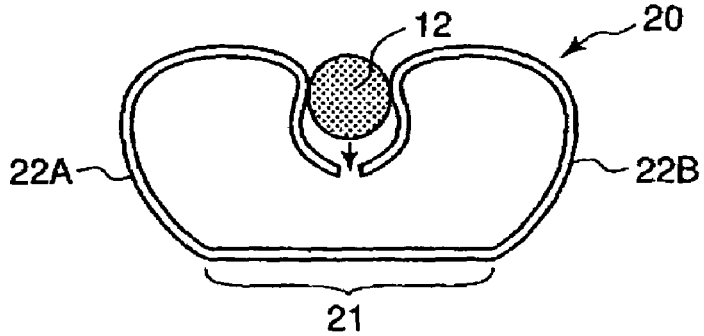
FIG. 4*b* is a schematic diagram illustrating a state in which the feeding terminal and the antenna rotary shaft are in the process of being combined with each other.
Figure 4C:
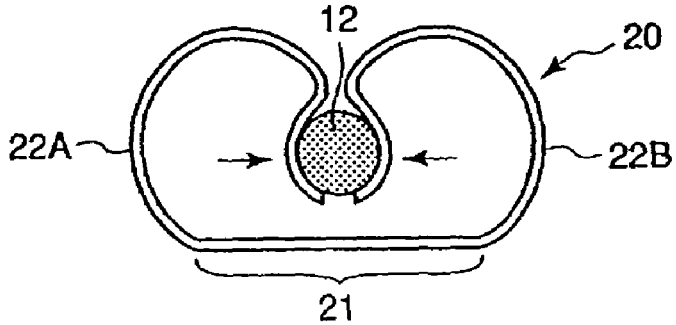
FIG. 4*c* is a schematic diagram illustrating a state in which the feeding terminal and the antenna rotary shaft are combined with each other.

FIG. 4*c* is a schematic front view of the feeding terminal 20 shown together with the antenna rotary shaft 12. As shown in the drawing, the pressing portions 22A, 22B sandwich the antenna rotary shaft 12 from opposite sides with elastic forces. The pressing portions 22A, 22B are in surface-contact with the peripheral surface of the antenna rotary shaft 12 and thus press against the antenna rotary shaft 12. The antenna rotary shaft 12 is in pressure-contact with the pressing portions 22A, 22B of the feeding terminal 20, whereby the antenna rotary shaft 12 is electrically connected to the electric circuit 6 of the circuit substrate 5 via the feeding terminal 20.

Since the pressing portions 22A, 22B are in surface-contact with the peripheral surface of the antenna rotary shaft 12 and thus press against the antenna rotary shaft 12, a frictional torque is generated in the antenna rotary shaft 12. In other words, according to this embodiment, the frictional force between the pressing portions 22A, 22B and the antenna rotary shaft 12 is set such that when the O ring 15 which maintains the antenna-rotational-position becomes damaged, the pressing portions 22A, 22B function alternatively to maintain the antenna-rotational-position in place of the O ring 15. Specifically, the pressing force applied to the antenna rotary shaft 12 by the pressing portions 22A, 22B, for example, is set such that the frictional force is prevented from interfering with the smooth rotation of the antenna 7 while still having the capability to maintain the rotational adjustment position of the antenna 7. Accordingly, the pressing portions 22A, 22B generate a frictional force with respect to the antenna rotary shaft 12 such that the pressing portions 22A, 22B can function to maintain the antenna-rotational-position.

As described above, according to this embodiment, the circuit substrate 5 is mounted to the back cover 3, and the antenna rotary shaft 12 is securely supported by the front cover 2. Moreover, an insertion inlet 24 between the pair of pressing portions 22A, 22B is located at an upper portion of the feeding terminal 20. Accordingly, during the manufacturing process, for example, when the front cover 2 having the antenna rotary shaft 12 attached thereto is being placed over the back cover 3 having the circuit substrate 5 fixed thereto, the antenna rotary shaft 12 is pressed against the elastic forces of the pressing portions 22A, 22B so as to become inserted between the pair of pressing portions 22A, 22B through the insertion inlet 24, as shown in FIGS. 4*a* to 4*b*. In this combined state of the front cover 2 and the back cover 3, the antenna rotary shaft 12 is in surface-contact with the pressing portions 22A, 22B, whereby the antenna rotary shaft 12 is elastically sandwiched between the pressing portions 22A, 22B from opposite sides. In other words, by simply combining the front cover 2 and the back cover 3, the antenna rotary shaft 12 can be elastically sandwiched between the pressing portions 22A, 22B of the feeding terminal 20. Consequently, the manufacturing process does not require a troublesome step, such as a positional adjustment step for the antenna rotary shaft 12 with respect to the feeding terminal 20, thereby simplifying the manufacturing process for the card device 1.

According to this embodiment, since the feeding terminal 20 presses against the antenna rotary shaft 12 from opposite sides using its elastic force in order to sandwich the antenna rotary shaft 12 in a surface-contact fashion, the reliability of the electrical connection between the feeding terminal 20 and the antenna rotary shaft 12 is improved. Furthermore, since the elastic force of the feeding terminal 20 is a force acting in a direction parallel to the substrate surface of the circuit substrate 5 instead of a force acting in a direction that lifts the feeding terminal 20 from the circuit substrate 5, the feeding terminal 20 is prevented from becoming detached from the circuit substrate 5 due to the elastic force of the feeding terminal 20 itself.

Furthermore, according to this embodiment, the feeding terminal 20 is electrically connected to the electric circuit 6 of the circuit substrate 5 by mounting the feeding terminal 20 to the circuit substrate 5 with a bonding material, such as solder. Accordingly, in a conduction path for a signal traveling between the antenna 7 and the electric circuit 6 of the circuit substrate 5, only one contact point between conductors exists, which is the contact point between the feeding terminal 20 and the antenna rotary shaft 12. Consequently, since this embodiment has a reduced number of contact points between conductors in the signal conduction path between the antenna 7 and the electric circuit 6, conduction failures caused by contact points and large signal losses can be reduced. This enhances the reliability of the electrical connection (signal conduction) between the antenna 7 and the electric circuit 6 of the circuit substrate 5, thereby improving the radio communication performance of the card device 1.

Generally speaking, for example, if the feeding terminal is connected to the electric circuit of the circuit substrate only by being in contact with, for example, a land disposed on the circuit substrate, the surface of the land must be, for example, gold-plated in order to enhance the reliability of the connection between the feeding terminal and the land. In contrast, according to this embodiment, the feeding terminal 20 is connected to the electric circuit 6 of the circuit substrate 5 by mounting the feeding terminal 20 to, for example, the land of the circuit substrate 5 using a bonding material, such as solder. For this reason, the land does not need to be, for example, plated with gold. This contributes to lower manufacturing costs, whereby the card device 1 can be provided at a lower cost.

Furthermore, in this embodiment, since the feeding terminal 20 is fixed to the circuit substrate 5 using a bonding material, such as solder, the feeding terminal 20, for example, can be mounted to the circuit substrate 5 in the same process for soldering other electronic components to the circuit substrate 5. Accordingly, this eliminates the need for a troublesome step, such as a screwing step for attaching the feeding terminal 20, whereby the manufacturing process of the card device 1 can be simplified. This leads to lower manufacturing costs for the card device 1, thereby contributing to a cost reduction of the card device 1.

Furthermore, in this embodiment, the inner surface of the card casing 4 is provided with the antenna-rotary-shaft supporting portion 18. According to this structure, the antenna rotary shaft 12 is supported by a side wall of the card casing 4 and the antenna-rotary-shaft supporting portion 18 disposed in the inner surface of the card casing 4. Consequently, in a case where the antenna 7 receives an impact and the antenna rotary shaft 12 thus receives an external stress, the external stress applied to the antenna rotary shaft 12 can be released to the card casing 4 through the side wall of the card casing 4 and the antenna-rotary-shaft supporting portion 18. In addition, the pressing portions 22A, 22B of the feeding terminal 20 that are in contact with the antenna rotary shaft 12 have elasticity. For this reason, even when an external stress is applied to the feeding terminal 20 by the antenna rotary shaft 12 itself, the external stress is absorbed by the elasticity of the pressing portions 22A, 22B. Accordingly, the external stress from the antenna rotary shaft 12 is prevented from being applied to the circuit substrate 5 via the feeding terminal 20. In other words, according to this embodiment, when the antenna 7 receives an impact, the external stress is prevented from being applied directly to the circuit substrate 5 through the antenna rotary shaft 12. This prevents, for example, the feeding terminal 20 from becoming detached from the circuit substrate 5. Accordingly, a card device 1 having resistance to an impact from an external source can be provided.

Furthermore, in this embodiment, the front cover 2 and the back cover 3 are combined with each other by securely hooking the hook portions F of the extended wall segments 3*a*, 3*b* provided in the back cover 3 onto the hook-receiving portions 10*f* of the front cover 2. Consequently, the process for combining together the front cover 2 and the back cover 3 does not require a troublesome step, such as a screwing step, whereby the manufacturing process for the card device 1 is simplified. Moreover, since the front cover 2 and the back cover 3 are mechanically combined with each other, there is less possibility of deterioration in the mechanical connection between the front cover 2 and the back cover 3, such as a detachment between the front cover 2 and the back cover 3. Accordingly, this increases the mechanical strength of the card casing 4.

Furthermore, according to this embodiment, the antenna rotary shaft 12 is securely supported by the front cover 2, and the back cover 3 holds the circuit substrate 5 having the feeding terminal 20 fixed thereon. In general, if the mechanical connection between the front cover 2 and the back cover 3 deteriorates, the elastic grip on the antenna rotary shaft 12 by the elastic pressing force of the feeding terminal 20 may possibly be broken. In contrast, according to this embodiment as described above, the front cover 2 and the back cover 3 are mechanically combined with each other by securely hooking the hook portions F of the back cover 3 onto the hook-receiving portions 10*f* of the front cover 2. Consequently, this strengthens the combined state between the front cover 2 and the back cover 3, thereby preventing the sandwiched state of the antenna rotary shaft 12 by the elastic pressing force of the feeding terminal 20 from becoming lost due to deterioration in the combined state between the front cover 2 and the back cover 3. Accordingly, this enhances the reliability of the electrical connection between the antenna 7 and the electric circuit 6 of the circuit substrate 5.

The technical scope of the present invention is not limited to the above embodiments, and modifications are permissible within the scope and spirit of the present invention. For example, although the card device 1 in this embodiment is an extended type, the present invention is applicable to a type of a card device that does not have the extended portion E.

Furthermore, although the front cover 2 includes the frame 10 composed of, for example, a resin material and the panel 11 formed of a metal plate according to this embodiment, the front cover 2 may alternatively have a single-piece body composed entirely of the same resin material (for example, non-crystalline plastic, such as polycarbonate) and formed by, for example, molding the resin material into the same shape as the shape described in this embodiment.

Furthermore, although the antenna-rotational-position maintaining means includes the O ring 15 in this embodiment, a wave washer, lock washer or spring washer, for example, may be provided in place of the O ring 15. In that case, the antenna-rotational-position maintaining means may maintain the rotational adjustment position of the antenna 7 using the frictional force generated between the wave washer, for example, and the projection 12A of the antenna rotary shaft 12. As a further alternative, the antenna-rotational-position maintaining means may include a spring. Accordingly, there are various types of mechanisms for maintaining the rotational adjustment position of the antenna 7, and any one of these types of mechanisms may be used as the antenna-rotational-position maintaining means.

Furthermore, because the pressing portions 22A, 22B included in the feeding terminal 20 can also function as the antenna-rotational-position maintaining means in this embodiment, the antenna-rotational-position maintaining means (other than the pressing portions 22A, 22B), such as the O ring 15, may alternatively be omitted. In that case, the number of components can advantageously be reduced.

Figure 5:
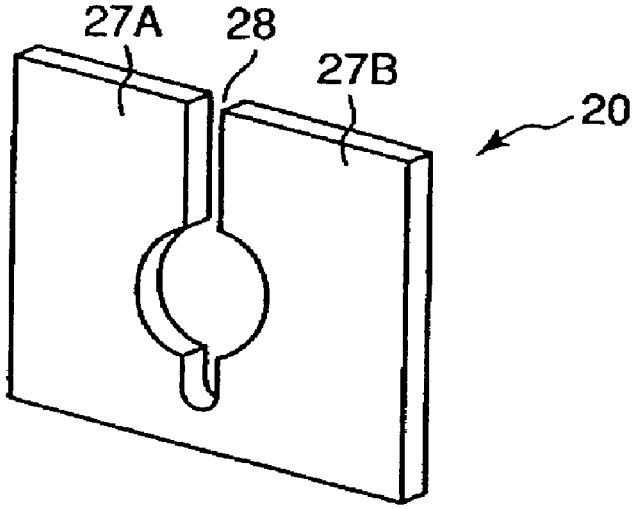
FIG. 5 is a schematic diagram illustrating an alternative example of the feeding terminal.
Figure 6:
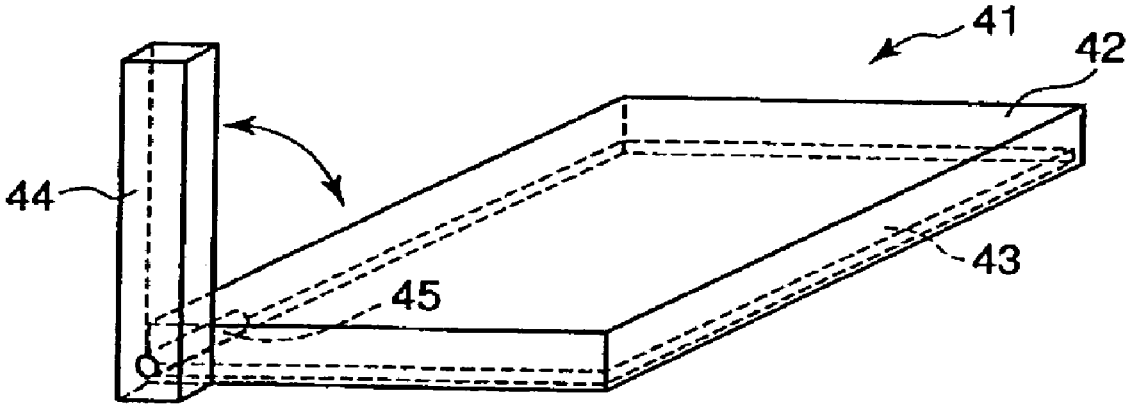
FIG. 6 Prior Art
FIG. 6 is a simplified schematic diagram illustrating an example of a conventional card device.
Figure 7:
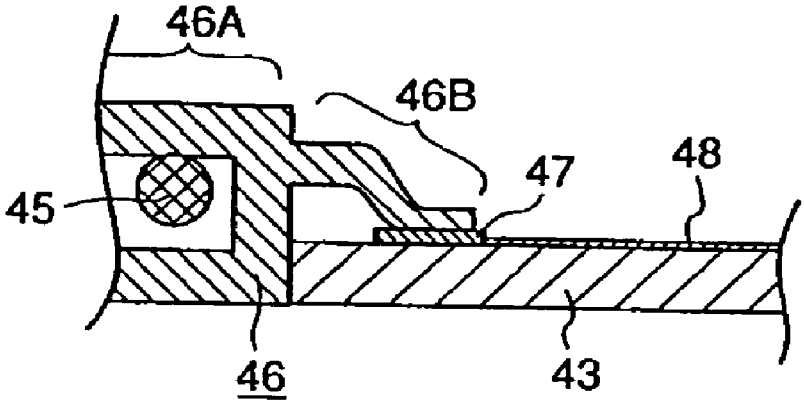
FIG. 7 Prior Art
FIG. 7 is a schematic diagram illustrating an example of a conventional configuration in which an antenna rotary shaft is electrically connected to a circuit on a circuit substrate via a feeding terminal.

Furthermore, the feeding terminal may have alternative shapes other than the shape shown in FIG. 3 as long as it has a pair of pressing portions that sandwich the antenna rotary shaft from opposites sides with elastic forces in a surface-contact fashion. For example, a type of feeding terminal 20 shown in FIG. 5 may be applied. The feeding terminal 20 of this type is formed by punching out a metal plate. This feeding terminal 20 also has a pair of pressing portions 27A, 27B that sandwich the antenna rotary shaft 12 from opposite sides with elastic forces. An insertion inlet 28 between the pair of pressing portions 27A, 27B is located at an upper portion of the feeding terminal 20.

Furthermore, although only one antenna-rotary-shaft supporting portion 18 is provided in this embodiment, a plurality of antenna-rotary-shaft supporting portions 18, for example, may alternatively be provided in such a manner that the antenna-rotary-shaft supporting portions 18 are separated from each other by a certain distance. In that case, the antenna rotary shaft 12 extending into the card casing 4 may be supported by the antenna-rotary-shaft supporting portions 18 at multiple positions.

The present invention provides a simplified manufacturing process for the card device and higher reliability of the card device. Therefore, the present invention is effective for, for example, general-purpose card devices.

What is claimed is:

1. A card device comprising:

a card casing housing a circuit substrate; and an antenna which is disposed rotatably at an exterior of the card casing and is electrically connected to an electric circuit provided on the circuit substrate; wherein a side wall of the card casing is provided with a through hole through which an antenna rotary shaft extends, the antenna rotary shaft being disposed at a base end of the antenna and being composed of a conductive material, the antenna rotary shaft extending from the exterior of the card casing towards the interior of the card casing through the through hole, the antenna rotary shaft being disposed along a substrate surface of the circuit substrate in the card casing while being separated from the substrate surface;

a section of the circuit substrate that is opposed to the antenna rotary shaft has a feeding terminal fixed thereto, the feeding terminal being electrically connected to the electric circuit of the circuit substrate, the feeding terminal having a pair of antenna-rotary-shaft elastically-pressing portions that sandwich the antenna rotary shaft from opposite sides with elastic forces, the pair of antenna-rotary-shaft elastically-pressing portions being in pressure-contact with the antenna rotary shaft by being in surface-contact with a peripheral surface of the antenna rotary shaft, the antenna rotary shaft being thereby electrically connected to the electric circuit of the circuit substrate via the antenna-rotary-shaft elastically-pressing portions;

each of the pair of antenna-rotary-shaft elastically-pressing portions includes a contact surface arranged to be in contact with the antenna rotary shaft;

the feeding terminal includes a mounting portion arranged to be fixed to the circuit substrate; and the contact surfaces and the mounting surface are defined by the same surface of the feeding terminal.

2. The card device according to claim 1, wherein the feeding terminal is fixed to the circuit substrate with a conductive bonding material.

3. The card device according to claim 1, wherein an inner surface of the card casing is provided with an antenna-rotary-shaft supporting portion that rotatably supports the antenna rotary shaft extending into the card casing through the through hole in such a manner that the antenna rotary shaft is elevated from the circuit substrate.

4. The card device according to claim 3, wherein the feeding terminal has an insertion inlet disposed between the pair of antenna-rotary-shaft elastically-pressing portions and located at an upper portion of the feeding terminal, wherein the card casing includes a combination of a front cover and a back cover, the front cover being disposed proximate a front surface of the circuit substrate, the back cover being disposed proximate a back surface of the circuit substrate;

the antenna-rotary-shaft supporting portion is disposed at an inner surface of the front cover of the card casing;

the antenna rotary shaft is rotatably supported by the front cover;

when the front cover is disposed over the circuit substrate on the back cover such that the front cover and the back cover are combined together, the antenna rotary shaft is inserted between the pair of antenna-rotary-shaft elastically-pressing portions of the feeding terminal; and when the antenna rotary shaft is completely inserted between the pair of antenna-rotary-shaft elastically-pressing portions, the antenna-rotary-shaft elastically-pressing portions elastically press against the antenna rotary shaft so as to sandwich the antenna rotary shaft, whereby the antenna rotary shaft is electrically connected to the electric circuit of the circuit substrate.

5. The card device according to claim 1, wherein the card casing includes a combination of a front cover and a back cover, the front cover being disposed proximate a front surface of the circuit substrate, the back cover being disposed proximate a back surface of the circuit substrate;

a first one of the front cover and the back cover is provided with an extended wall segment extending along an outer surface of a side wall of a second one of the front cover and the back cover, the extended wall segment having a hook portion on a tip thereof;

the second cover is provided with a hook-receiving portion onto which the hook portion is securely hooked; and the front cover and the back cover are combined with each other by hooking the hook portion of the first cover onto the hook-receiving portion of the second cover.

6. A card device comprising:

a card casing housing a circuit substrate; and an antenna which is disposed rotatably at an exterior of the card casing and is electrically connected to an electric circuit providing on the circuit substrate, the antenna having an antenna rotary shaft, the antenna rotary shaft being composed of a conductive material, the antenna rotary shaft extending from the exterior of the card casing towards the interior of the card casing; wherein a section of the circuit substrate has a feeding terminal fixed thereto, the feeding terminal being electrically connected to the electric circuit of the circuit substrate, the feeding terminal having a pair of elastic pressing portions that sandwich the antenna rotary shaft from opposite sides with elastic forces, the pair of pressing portions being in pressure-contact with a peripheral surface of the antenna rotary shaft, the antenna rotary shaft being thereby electrically connected to the electric circuit of the circuit substrate via the pressing portions;

each of the pair of elastic pressing portions includes a contact surface arranged to be in contact with the antenna rotary shaft;

the feeding terminal includes a mounting portion arranged to be fixed to the circuit substrate; and the contact surfaces and the mounting surface are defined by the same surface of the feeding terminal.

7. The card device according to claim 6, wherein the feeding terminal is fixed to the circuit substrate with a conductive bonding material.

* * * * *

UNITED STATES PATENT AND TRADEMARK OFFICE

CERTIFICATE OF CORRECTION

PATENT NO. : 7,659,854 B2
APPLICATION NO. : 10/575810
DATED : February 9, 2010
INVENTOR(S) : Wataru Kakinoki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 879 days.

Signed and Sealed this

Thirtieth Day of November, 2010

David J. Kappos

David J. Kappos
*Director of the United States Patent and Trademark Office*